United States Patent [19]

Tanaka et al.

[11] Patent Number: 4,625,514

[45] Date of Patent: Dec. 2, 1986

[54] HEATER HEAD ASSEMBLY OF HEATED-GAS ENGINE

[75] Inventors: Tetsuya Tanaka, Toyota; Kazuaki Yamaguchi, Kariya, both of Japan

[73] Assignee: Aisin Seiki Kabushiki Kaisha, Kariya, Japan

[21] Appl. No.: 712,740

[22] Filed: Mar. 18, 1985

[30] Foreign Application Priority Data

Mar. 26, 1984 [JP] Japan ..... 59-43584[U]

[51] Int. Cl.[4] ..... F02G 1/04

[52] U.S. Cl. ..... 60/517; 60/525; 60/526

[58] Field of Search ..... 60/517, 525, 526

[56] References Cited

U.S. PATENT DOCUMENTS 4,249,377 2/1981 Bratt et al. ..... 60/517

4,499,726 2/1985 Bratt ..... 60/517

*Primary Examiner*—Allen M. Ostrager

*Attorney, Agent, or Firm*—Burns, Doane, Swecker and Mathis

[57] ABSTRACT

A heater head assembly for a Stirling-type engine has a cylinder and a regenerator housing each of which includes a manifold as an integral part thereof, and heater tubes inserted at one end into the cylinder manifold and at the other end into the regenerator housing manifold linking the cylinder and regenerator housing. Each manifold is broadened longitudinally on the heater tube side so that a working gas flow passage defined by the inner wall thereof has a longitudinal width greater than the inner diameter of the corresponding cylinder or regenerator housing. The inner wall of each manifold makes a smooth, gradual and successive transition from the broader portion of the manifold on the heater tube side to the inner wall of the narrower corresponding cylinder or regenerator housing without forming a sudden constriction in the working gas flow passage.

2 Claims, 7 Drawing Figures

HEATER HEAD ASSEMBLY OF HEATED-GAS ENGINE

BACKGROUND OF THE INVENTION

1. Field of the Invention

This invention relates to improvements in the heater head assembly of a heated-gas engine, particularly a Stirling engine. The heater head assembly is of the type having a bundle of heater tubes connecting a cylinder to a regenerator housing via a manifold on either the cylinder side, regenerator housing side or on both the cylinder and regenerator housing sides.

2. Description of the Prior Art

In a Stirling engine, fuel injected from a spray nozzle is mixed with air and the air-fuel mixture is combusted in a combustion chamber. A bundle of heater tubes constituting part of the engine heater head assembly and linking a cylinder with the housing of a regenerator are heated by the combustion gas before the gas is discharged from the combustion chamber. In a typical configuration, the heater tubes are connected at one end to a manifold on the cylinder side and at the other end to a manifold on the regenerator housing side. A working gas sealed within the heater tubes reciprocates between the cylinder and regenerator housing via the manifolds and picks up the thermal energy given off by the combustion gas in the combustion chamber. In order to achieve a uniform flow rate distribution of the working gas which flows into the heater tubes, flow straightening vanes are provided near manifold connection ports where the manifolds are connected to the cylinder and regenerator housing.

The prior-art heater head assembly of this type involves a number of problems which stem from the particular connection configuration between the manifolds and the cylinder or regenerator housing. Specifically, the portion of each manifold where the connection is made defines a flow passage which is constricted on the cylinder or housing side and of considerably larger width on the heater tube side. These connection portions magnify the influence of working gas inertia and causes a sudden change in the direction of working gas flow, particularly when the engine is operating at high speed. Since such a change in flow direction meets considerable resistance, there is greater pressure loss and a flow rate distribution which favors the heater tubes at both ends of each manifold. The end result is a decline in engine output.

Another disadvantage of the conventional heater head assembly is that the manifolds are formed separately of the cylinder and regenerator housing and must be welded to these units while maintaining strict positional accuracy. This is followed by drilling holes into the manifolds so that the ends of the heater tubes may be inserted. Such a construction entails numerous manufacturing steps, higher machining costs and a number of welds which can have a deleterious effect upon reliability and durability.

A further drawback encountered in the prior art is the necessity of the flow straightening vanes. These require the drilling of holes in the manifolds so that the vanes may be installed, followed by welding work for installation. High machining costs and reliability problems are the result.

SUMMARY OF THE INVENTION

An object of the present invention is to eliminate the aforementioned problems encountered in the prior art.

Another object of the present invention is to provide a heater head assembly of a heated-gas engine, which heater head assembly features a uniform working gas flow rate distribution yet little working gas pressure loss under a wide variety of engine running conditions.

A further object of the present invention is to provide a heated-gas engine heater head assembly which is highly reliable, durable and produced through fewer manufacturing steps and at lower cost by virtue of fewer individual parts and welds.

According to the present invention, the foregoing objects are attained by providing a heater head assembly of a heated-gas engine, comprising a cylinder, a regenerator housing, a first manifold formed integral with the cylinder and a second manifold formed integral with the regenerator housing, and heater tubes for connecting the cylinder and the regenerator housing via the manifolds. Each manifold is broadened longitudinally on the heater tube side so that a working gas flow passage defined by the inner wall thereof has a longitudinal width greater than the inner diameter of the corresponding cylinder or regenerator housing of which the manifold is an integral part. The inner wall of each manifold makes a smooth, gradual and successive transition from the broader portion of the manifold on the heater tube side to the inner wall of the narrower corresponding cylinder or regenerator housing without forming a sudden constriction in the flow passage. As a result, a change in cross sectional area of the working gas passage or in the direction of working gas flow takes place in a smooth and gradual manner. In a further aspect of the invention, insertion holes provided in an end face of the manifold for the purpose of receiving the ends of the respective heater tubes inserted therein are arranged in two rows so that the ends of the heater tubes may be arrayed in two rows. This permits the longitudinal length of the manifold to be reduced.

Owing to the foregoing construction of the present invention, the passage for the flow of working gas between the cylinder and the heater tubes and between the regenerator housing and the heater tubes changes the flow of working gas in a smooth and gentle manner to substantially equalize the flow rate distribution and reduce working gas pressure loss, especially during high speed operation of the engine.

Since the manifolds are formed as integral parts of the cylinder and regenerator housing and hence are devoid of the constricted connection portions required in the prior art, there is less dead volume interiorly of the heater tubes and therefore an increase in engine output. Further, unlike the prior art in which the manifolds are formed separately of the cylinder and regenerator housing, welded to the cylinder and housing and then machined to provide the insertion holes for the heater tubes, in the present invention the manifolds are formed as integral parts of the cylinder and regenerator housing and provided with the insertion holes. This arrangement entails fewer manufacturing steps, lower machining costs and one less weld per manifold, the latter feature enhancing reliablity and durability. Another advantage of the present invention is that the flow straightening vanes required in the prior art may be dispensed with in order to achieve a further reduction in machining cost and a further improvement in reliability.

Other features and advantages of the present invention will be apparent from the following description taken in conjunction with the accompanying drawings, in which like reference characters designate the same or similar parts throughout the figures thereof.

FURTHER DESCRIPTION OF THE PRIOR ART

Figure 1:
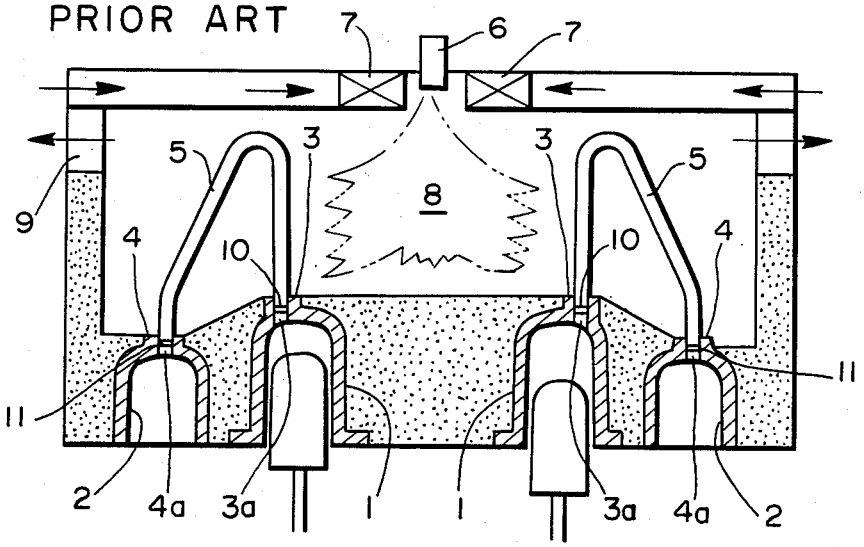
FIG. 1 PRIOR ART
FIG. 1 is a sectional view illustrating a heater head assembly of a heated-gas engine according to the prior art.
Figure 2:
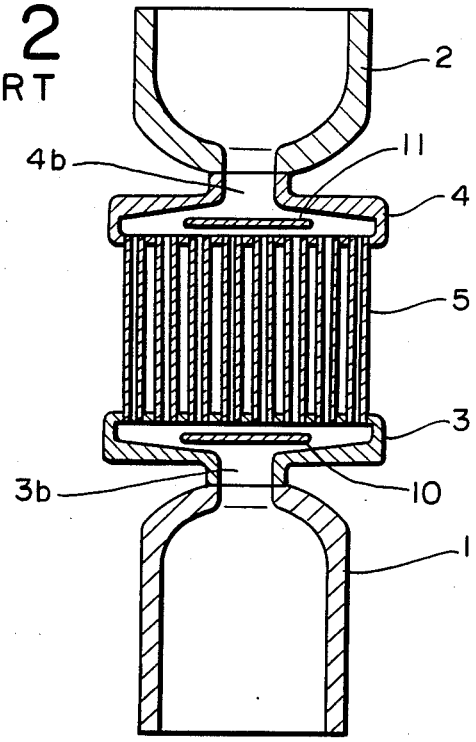
FIG. 2 PRIOR ART
FIG. 2 is an enlarged, more detailed sectional view showing the manner in which heater tubes are connected to a cylinder and regenerator housing via manifolds in the prior-art heater head assembly of FIG. 1.
Figure 3:
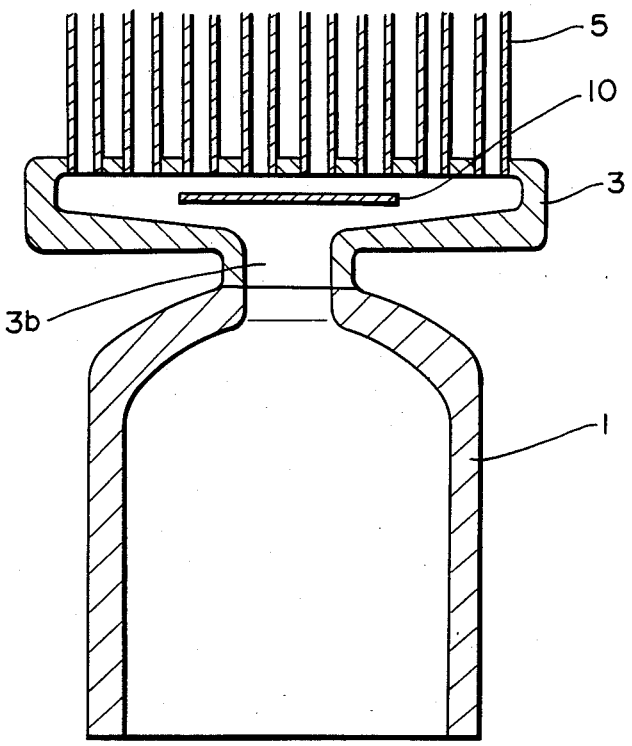
FIG. 3 PRIOR ART
FIG. 3 is an enlarged sectional view of a portion of FIG. 2 and shows the connection between the heater tubes and cylinder via the corresponding manifold.

Before describing a preferred embodiment of the present invention, reference will be had to FIGS. 1 through 3 to give a more detailed description of a conventional heater head assembly to which the present invention pertains and of the shortcomings possessed by such a heater head assembly.

As shown in FIGS. 1 and 2, the assembly includes a cylinder 1, a regenerator housing 2, and a number of heater tubes 5 exposed to a combustion chamber 8 in a heated-gas engine such as a Stirling engine. The engine has a spray nozzle 6 for injecting fuel into the combustion chamber 8, and an air swirler 7 from which air is introduced and mixed with the injected fuel to form an air-fuel mixture which is burned in the combustion chamber 8 to heat the bundle of heater tubes 5. The combustion gases exit the combustion chamber 8 via a discharge port 9. As depicted in FIG. 2, the heater tubes 5 are connected at one end to the cylinder 1 via a manifold 3 manufactured separately of the cylinder 1 and welded thereto, and at the other end to the regenerator housing 2 via a manifold 4 likewise manufactured separately of the housing 2 and welded thereto. Confined within the heater tubes 5 is a working gas which reciprocates internally of the tubes between the cylinder 1 and regenerator housing 2 and which is imparted through the thin walls of the tubes with thermal energy produced by the combustion gases generated in the combustion chamber 8. The manifolds 3, 4 have connection ports 3*a*, 4*a* (FIG. 1) through which the interiors of the manifolds are communicated with the interiors of the cylinder 1 and regenerator housing 2, respectively. Provided respectively in the proximity of the connection ports 3*a*, 4*a* are flow straightening vanes 10, 11 by which it is attempted to uniformalize the flow rate distribution of the working gas which flows into the heater tubes 5.

As shown in FIG. 2, the manifolds 3, 4 include portions 3*b*, 4*b* at which the connections to the cylinder 1 and regenerator housing 2 are made, respectively. The conventional manifold configuration is such that an internally delimited flow passage through which the working gas travels is constricted from a region of considerable width on the heater pipe side down to a region of much reduced width on the side at which the connection to the cylinder 1 or housing 2 is made, namely at the connection portion 3*b* or 4*b*. This is best shown in FIG. 3, which depicts the connection between the heater pipes 5 and cylinder 1 via the manifold 3. Owing to the irregularly shaped gas flow passage, there is an increase in the influence of working gas inertia and a sudden change in the direction of working gas flow especially when the engine is running as high speed. Since there is an accompanying increase in resistance, greater pressure loss results, as well as a tendency for the flow rate distribution to favor the heater tubes 5 at both ends of the manifold. This ultimately diminishes engine output.

The present invention contemplates elimination of this and other problems encountered in the prior-art heater head assembly.

DESCRIPTION OF THE PREFERRED EMBODIMENT

Described hereinafter will be a preferred embodiment of a heater head assembly according to the present invention.

Figure 4:
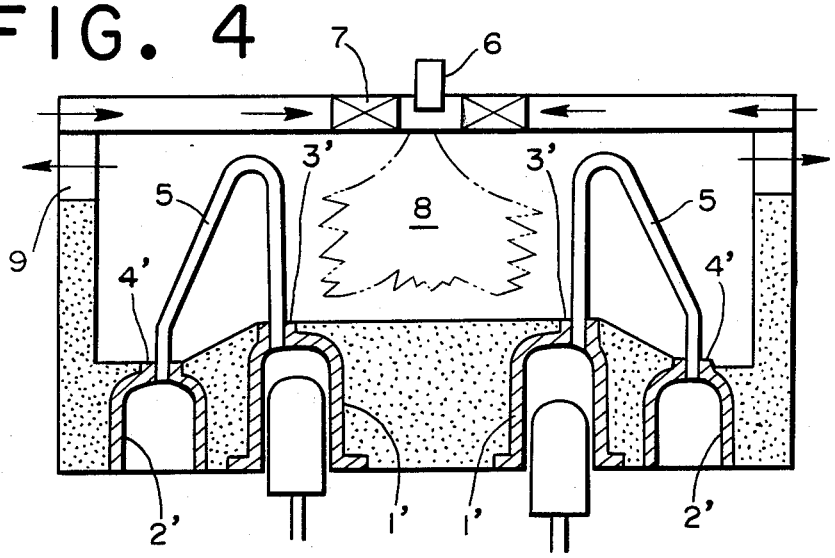
FIG. 4 is a sectional view illustrating a preferred embodiment of a heater head assembly of a heated-gas engine according to the present invention.

With reference first to FIG. 4, an engine to which the present invention is applied has the same configuration as that shown in FIG. 1. Specifically, fuel injected by the spray nozzle 6 is mixed with air supplied via the air swirler 7, the mixture is combusted in the combustion chamber 8 and the thermal energy of the combustion gases is transferred to the bundle of heater tubes 5 in the combustion chamber 8 prior to discharge of the combustion gases via the discharge port 9.

According to the present invention, the heater head assembly comprises a cylinder 1', a regenerator housing 2', a manifold 3' formed as an integral part of the housing 1', a manifold 4' formed as an integral part of the regenerator housing 2, and the multiplicity of heater tubes 5 connected at one end to the manifold 3' and at the other end to the manifold 4' to form a flow passage communicating the interior of the cylinder 1' with the interior of the regenerator housing 2 through the interior of the manifolds 3', 4' and heater tubes 5.

Figure 5:
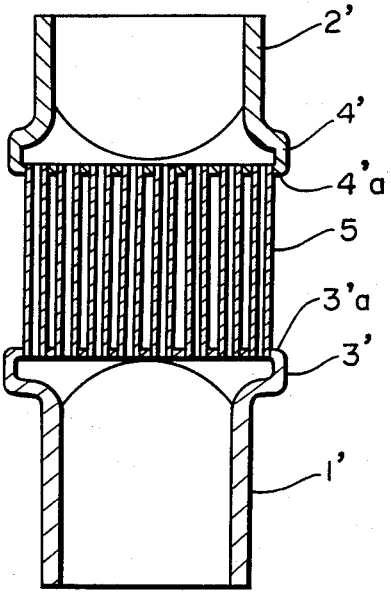
FIG. 5 is an enlarged, more detailed sectional view showing the manner in which heater tubes are connected to a cylinder and regenerator housing via manifolds in the heater head assembly of FIG. 4.
Figure 7:
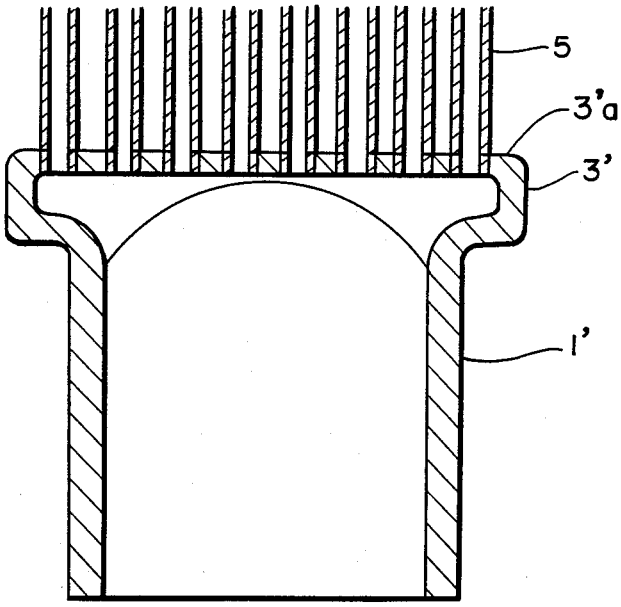
FIG. 7 is an enlarged sectional view of a portion of FIG. 5 and shows the connection between the heater tubes and cylinder via the corresponding manifold according to the present invention.

As best shown in FIGS. 5 and 7, the manifolds 3', 4' formed integral with the respective cylinder 1' and regenerator housing 2' are broadened longitudinally, i.e., at a generally right angle with respect to the heater tubes 5, so that the flow passage defined internally of each manifold by the inner wall thereof has a longitudinal width greater than the inner diameter of the corresponding cylinder 1' or regenerator housing 2'. The inner wall of each manifold 3', 4' makes a smooth, gradual and successive transition from the broader portion of the manifold at the ends of the heater tubes 5 to the inner wall of the narrower corresponding cylinder 1' or housing 2' without forming a sudden constriction in the flow passage at right angles to the longitudinal direction of the manifold. With such a configuration, the direction in which the working gas flows changes in a gentle and gradual manner and the working gas is capable of being fed uniformly into each of the heater tubes 5. It is worthwhile to note that this effect can be obtained without provision of the flow straightening vane required in the prior art.

The heater tubes 5 may be connected to the manifolds 3', 4' by press fitting the ends thereof into insertion holes formed beforehand in end faces 3'*a*, 4'*a* of the manifolds 3', 4', or by inserting the ends into these holes and then braizing them firmly into place.

Figure 6:
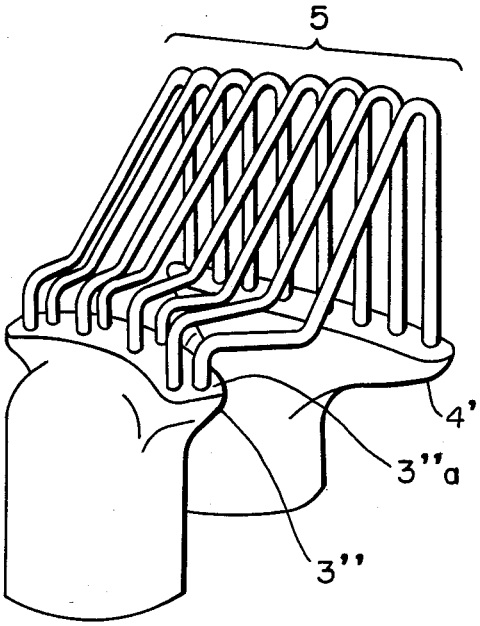
FIG. 6 is a perspective view of a modification of the invention in which the ends of the heater tubes connected to one manifold are arranged in two rows.

In a further aspect of the invention, the ends of the heater tubes 5 connected to one or both of the manifolds may be arranged in rows rather than in a single row as illustrated hereinabove. Such an embodiment is shown in FIG. 6, in which the heater tubes 5 are connected at one end to the manifold 4' on the regenerator housing side in the manner described and illustrated hereinabove, and at the other end to a manifold 3'' on the cylinder side. The end face 3''*a* of the manifold 3'' has a double row of insertion holes for receiving the inserted ends of the heater tubes 5 in a two-row array. The manifold 3' has a configuration similar to that of the manifold 3' but, by virtue of the double-row arrangement of the heater tube ends, features a shorter longitudinal length so that there is even less relative constriction of the flow path and a greater width at right angles to the longitudinal direction. It should be noted that the same double-row arrangement of the heater tube ends may be adopted for the manifold 4'. In addition, the double-row configuration is for illustrative purposes only, for the ends of the heater tubes may be arrayed in more than two rows if desired.

Returning to FIGS. 4, 5 and 7, the working gas sealed within the heater tubes 5 reciprocates between the cylinder 1' and regenerator housing 2' via the manifolds 3', 4' and acquires through the walls of the heater tubes the thermal energy produced in the combustion chamber 8, as in the prior art.

As many apparently widely different embodiments of the present invention can be made without departing from the spirit and scope thereof, it is to be understood that the invention is not limited to the specific embodiments described above. Variations and changes may be made by those skilled in the art without departing from the spirit of the present invention. Accordingly, the foregoing detailed description should be considered exemplary in nature and not limited to the scope and spirit of the invention as set forth in the attached claims.

What we claim is:

1. A heater head assembly of a heated-gas engine, comprising;

a plurality of cylinders arranged along a periphery of a combustion chamber;

a plurality of regenerator housings positioned radially outwardly of said plurality of cylinders;

a first manifold formed integrally with each of said cylinders;

a second manifold formed integrally with each of said regenerator housings; and a bundle of heater tubes having first ends received in said first manifold and second ends received in said second manifold for connecting said cylinders and said regenerator housings through said first and second manifolds;

each of said first manifolds having an end face provided with insertion holes arranged in two rows for receiving the first ends of respective ones of said heater tubes, and an inner wall defining a working gas flow passage which is gradually and successively constricted from a width adjacent said end face greater than an inner diameter of the corresponding cylinder to a width substantially equivalent to said inner diameter, thereby substantially equalizing flow of the working gas from said corresponding cylinder into said heater tubes and from said heater tubes into said corresponding cylinder;

each of said second manifolds having an end face provided with insertion holes for receiving the second ends of respective ones of said heater tubes, and an inner wall defining a working gas flow passage which is gradually and successively constricted from a width adjacent said end face greater than an inner diameter of the corresponding regenerator housing to a width substantially equivalent to said inner diameter, thereby substantially equalizing flow of the working gas from said corresponding regenerator housing into said heater tubes and from said heater tubes into said corresponding regenerator housing.

2. The heater head assembly according to claim 1, wherein the insertion holes of each of said second manifolds are arranged in two rows, and each of said manifolds is reduced in length longitudinally thereof.

* * * * *